US005799897A

United States Patent [19]

Honegger

[11] Patent Number: 5,799,897

[45] Date of Patent: Sep. 1, 1998

[54] METHOD FOR SUPPLYING PRINTED PRODUCTS IN SCALED FORMATION TO PROCESSING STATIONS AND SYSTEM FOR CARRYING OUT THE METHOD

[75] Inventor: Werner Honegger, Bäch, Switzerland

[73] Assignee: Ferag AG, Hinwil, Switzerland

[21] Appl. No.: 701,452

[22] Filed: Aug. 22, 1996

[30] Foreign Application Priority Data

Sep. 20, 1995 [CH] Switzerland ..... 02 656/95

[51] Int. Cl.[6] ..... B65H 29/00

[52] U.S. Cl. ..... 242/528; 242/533.8; 242/559; 53/118

[58] Field of Search ..... 242/364, 364.1, 242/403, 528, 557, 558, 559, 560; 53/118, 430; 414/783, 910, 911

[56] References Cited

U.S. PATENT DOCUMENTS

| | | | |
|---|---|---|---|
| 4,601,436 | 7/1986 | Honegger | 53/118 |
| 4,676,496 | 6/1987 | Honegger | 242/559 |
| 4,684,118 | 8/1987 | Boss et al. | 242/528 |
| 4,697,400 | 10/1987 | Gerber | 242/528 |
| 4,703,901 | 11/1987 | Stauber | 198/468.9 |
| 4,769,973 | 9/1988 | Reist | 53/430 |
| 4,866,910 | 9/1989 | Reist | 242/528 |
| 4,898,336 | 2/1990 | Reist | 242/528 |
| 4,925,120 | 5/1990 | Meier | 414/789.2 |
| 4,928,899 | 5/1990 | Reist | 53/118 |
| 5,022,807 | 6/1991 | Linder | 242/528 |
| 5,379,963 | 1/1995 | Stauber | 242/533.8 |
| 5,398,883 | 3/1995 | Stauber | 242/533.8 |

FOREIGN PATENT DOCUMENTS

| | | | |
|---|---|---|---|
| 2 144 108 | 2/1985 | United Kingdom | 242/528 |
| 2 216 108 | 10/1989 | United Kingdom | 242/528 |
| 2297541 | 8/1996 | United Kingdom . | |

*Primary Examiner*—John P. Darling
*Attorney, Agent, or Firm*—Birch, Stewart, Kolasch & Birch, LLP

[57] ABSTRACT

A method and a system are used for supplying printed products such as newspapers, magazines or brochures or intermediate products for such printed products (sheets, part-products) as substantially continuous scaled streams to a plurality of feeding points of processing stations. The method and system are designed to allow a supply which is as flexible as possible and at the same time economic. The scaled streams are continuous and are produced selectably from products in storage formations, e.g. rolls, vertical stacks, manipulatable stacks, spiral stacks. Discrete scaled formations are prepared in separate method steps in which different loading devices depending on the product formation and supplying devices are loaded with these scaled formations. Loaded supplying devices are transported to the feeding points. Discrete scaled formations are brought from supplying devices into feeding buffers, allocated to feeding points, and products are fed from feeding buffers into processing stations as substantially continuous scaled formations. The orientation of scale for the feeding is already formed when the discrete scaled formation is produced and is not changed thereafter. The loaded supplying devices are, if necessary, stored intermediately before, after or during the transport to the feeding points.

13 Claims, 4 Drawing Sheets

METHOD FOR SUPPLYING PRINTED PRODUCTS IN SCALED FORMATION TO PROCESSING STATIONS AND SYSTEM FOR CARRYING OUT THE METHOD

BACKGROUND OF THE INVENTION

1. Field of the Invention

The invention is in the field of conveyance and intermediate storage of printed products, e.g. of newspapers, magazines or brochures or of intermediate products, (e.g. sheets, product parts) for such printed products. The invention concerns a method and a system for conveyance and intermediate storage of the products. The method and system serve for supplying a plurality of continuous streams of printed products in scaled formation with given scale-orientation which streams consist of printed products or intermediate products for printed products and are supplied to processing stations in which the products are further processed in a substantially continuous manner. The scaled streams to be supplied are produced from printed products or from intermediate products for printed products being provided discontinuously in the form of discrete storage formations or being provided continuously, e.g. in the form of scaled streams already.

2. Description of the Related Art

Printed products or intermediate products for printed products to be supplied in scaled formation continuously to processing stations can have many different forms and sizes, i.e. they can be simple leafs, sheets folded once or several times, pluralities of sheets folded inside each other, signatures, complete magazines or brochures or similar products.

Such products are supplied to very different processing stations for further processing such as collecting systems, inserting systems, collating systems or commissioning systems in which from a plurality of pre-products complete products, e.g. magazines, brochures, books or products with inserted supplements, are produced. The processing stations can also be stations in which no plurality of different kinds of pre-products is brought together but in which each individual product of the supplied scaled stream is processed individually, e.g. is stitched, cut or printed on. In any case, the scaled stream is to be supplied to a processing station with a given scale orientation. In other words this means that in each scaled stream to be supplied, the products are oriented with one defined edge facing downstream or upstream respectively and with one defined edge placed on the bottom side or on the top side of the stream respectively.

The products to be supplied in scaled formation to a processing station can come from different sources and can be provided in the most different formations. They can come from an intermediate storage as storage formations in form of vertical stacks (substantially horizontal products stacked on top of each other), manipulateable stacks (stacks held together with clamps or other means, such that their orientation is freely selectable), part stacks or layers (stacked crosswise to form cross stacks), spiral stacks or rolls (scaled formation wound onto a core). They can however also be provided substantially continuously, e.g. in form of one or more scaled streams from preceding processing stations.

According to the state of the art, scaled streams to be supplied to processing stations are produced from various kinds of storage formations of printed products or intermediate products, by providing feeding devices at the feeding points of the processing stations which feeding devices are equipped according to the storage formation to be handled.

Thus at the feeding points of e.g. a collecting, insertion or collating machine, unwinding stations are provided for products on rolls and sheet feeders or corresponding devices are provided for products in form stacks. For products which are provided on-line, i.e. which substantially form a continuously conveyed scaled formation, normally, corresponding scale buffers are provided on the feeding points for at least partially uncoupling supplying and processing speeds, especially for uncoupling irregularities of both sides.

As ever more and more flexibility is asked of processing and storage systems it becomes desirable for plants for further processing printed products, that every feeding point can be supplied not only with different kinds (format, size) of products but also with products provided in different storage formations (any sort of stack, packages, spirals, rolls) to be converted into a continuous scaled stream with a defined scale orientation. In other words this means that for each feeding point different feeding devices must be provided, the use of which feeding devices being selectable, or it means that mobile feeding devices have to be provided which devices are, according to the kind of production, connectable to one of the feeding points.

Systems with a collecting, insertion or collating machine and with a considerable number of feeding points each equipped with both a winding station and a sheet feeder are often used for flexible production. The feeding points of such systems are easily extendible with additional on-line connections. If however such an on-line connection is to comprise a buffer also, a scale buffer must be provided or the winding station must be equipped not only for unwinding but also for winding simultaneously, for buffering and rewinding if required.

Mobile sheet feeders with the help of which continuous scaled streams can be produced from all sorts of product stacks are in common use. Simple unwinding stations can also be mobile; normally however the winding stations are designed stationary due to their size and complexity, i.e. they are strictly allocated to one specific feeding point.

From the above it is obvious that for a process to be as flexible as possible and for being connectable with a storage also being as flexible as possible, i.e. for an operation in which a plurality of different formations of products and pre-products can easily be taken from the storage and processed further, a very large number of at least partly very expensive devices is required which devices not only require a large amount of space but are mostly operating on a limited rate only.

A further disadvantage of the systems described above is the fact that for each group of manned feeding devices (e.g. sheet feeders) installed adjacent to each other or even for each individual such device one operator is required which operator must work in a rhythm strictly defined by the process. This means that, depending on the kind of process varying numbers of operators are required who, again depending on the kind of process have to work to full capacity or to a limited rate of their capacity only. As these operators are also responsible for preventing any product of inferior quality (damaged, deformed products) to be fed, this means that they must spot and remove inferior products from the stacks and that if many such products must be removed they may become overstressed which again may cause interruptions in the whole processing facility.

SUMMARY OF THE INVENTION

In order to omit the disadvantages described above, it is the object of the invention to provide a method and a system for supplying a plurality of continuous scaled streams each with a defined scale orientation formed from selectably continuously or discontinuously provided printed products or intermediate products for printed products. The inventive method is to allow a more method-economic and more flexible supplying of continuous scaled streams produced from any storage formation to the feeding points of a processing station than conventional such methods do. The inventive system is nonetheless to be of less capital cost and is to require less space than corresponding known systems of the kind. Furthermore, the method is to be open for new or so far uncommon kinds of storage formations and the system is to be simply and with minimal expense extendible for handling such formations.

This object is achieved by the method and the system for carrying out the method as described in the claims.

In a flexible storage, printed products or intermediate products for printed products are stored in whatever storage formations, which may be very different from each other (e.g. vertical stacks, manipulateable stacks, spiral stacks, rolls), whereby the storage place is of no importance and often is not correlated to the kind of product and to their allocation to a specific process but rather to the kind of storage formation. The time when the products are stored away is again of no importance; the time when the products are taken out of the storage is also of no importance up to a limit which is defined by the course of the process.

On the other hand, the formation of products to be supplied to a process step is strictly defined. This formation is a continuous scaled stream of which the scales (printed products or groups of printed products or intermediate products for printed products or groups of these respectively) must have a defined orientation (defined upstream or downstream edge respectively, downstream edge on the bottom or on the top of the stream respectively). For products of a specific storage formation, the time in which they must be supplied to the process as well as the place (specific feeding point) where they must be supplied are defined within tight limits.

It is now the central idea of the inventive method to do the following in individual, separate method-steps:

- produce the product formations necessary for supply at the feeding points in form of temporarily discrete units, which means: preparing from any storage formation or from continuously provided products discrete scaled formations with a restricted length and a specific scale orientation (setting the feeding formation), whereby these discrete scaled formations are advantageously uniform for a whole plant, i.e. they have a form which is independent of the specific kind of product;
- transport the discrete scaled formations to the specific feeding locations and feed them into a feeding buffer strictly allocated to the one feeding point (setting the feeding location);
- and release the products at a defined time as continuous scaled stream from the feeding buffer for feeding them into the process (setting the feeding time);

whereby the scaled formation which is formed in the first method-step already has the given scale orientation with which the products are to be fed into the processing station and whereby this scale orientation is maintained through all the following steps. Between the feeding buffer and the actual feeding point, known steps for setting subordinated scale stream parameters can be inserted (changing scale distance, regularizing scale distances, aligning the products etc.) which settings require very simple devices only which are easily adjustable for different products. The discrete scaled formations may be intermediately stored, selectably before, after and/or during their transport to the feeding point, the temporal requirements of producing the formation and of further processing the products of the formation thus being largely independent from each other.

In the inventive method, in particular the production of the feeding formation is largely uncoupled from the processing of the products and can thus be carried out in its own optimal rhythm. This rhythm can also be adapted to the fluctuation of the quality of the products (ratio of products to be removed) without the necessity to throttle the process speed, let alone to stop the process. On the other hand, using methods according to the state of the art for the same purpose, feeding formation, feeding location and feeding time are to be set all in the same rhythm which is governed strictly by the process. This dictation by the process regarding production of the scaled streams to be supplied to the process can, with methods according to the state of the art, at he most be tempered if there is space for intermediate storage in the area of the feeding point such that at least the setting of the feeding location can be uncoupled better from the process.

Parallel to the inventive supplying method it is of course possible to supply products provided on-line in the form of continuous scaled streams directly into feeding buffers which are allocated to feeding points such that the method step of forming the discrete scaled formation is not required. Products fed on-line can also be supplied directly into the further processing, i.e. bypassing the feeding buffer allocated to the feeding point, if corresponding conveying means for bypassing the feeding buffer are provided.

A system for carrying out the method according to the invention as sketched above comprises for each different kind of formation (storage formation or continuous formation) in which products to be supplied can be provided, at least one loading device. With the help of the loading device such a formation is changed into a discrete scaled formation with defined scale orientation or into part of it. Furthermore, the system comprises for each feeding point a feeding buffer, which is strictly allocated to this feeding point and into which discrete scaled formations with defined scale orientation are fed and from which a substantially continuous scaled stream with the same scale orientation is fed into the process. Each of these feeding buffers is advantageously equipped such that it can also be fed with a scaled stream provided on-line and such that it can also be bypassed by such a stream. Furthermore, the system comprises a plurality of mobile supplying devices which are loaded by a loading device with a discrete scaled formation with defined product orientation, which are transported in empty or loaded condition and from which the discrete scaled formation with defined product orientation is unloaded again. The discrete scaled formation may also be intermediately stored in the supplying device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE INVENTION

The method and the system according to the invention as well as their specific advantages are described below more in detail in connection with the following figures, whereby FIG. 1 shows a system diagram from which the inventive method and the principle of the inventive system can be seen;

Figure 6A:
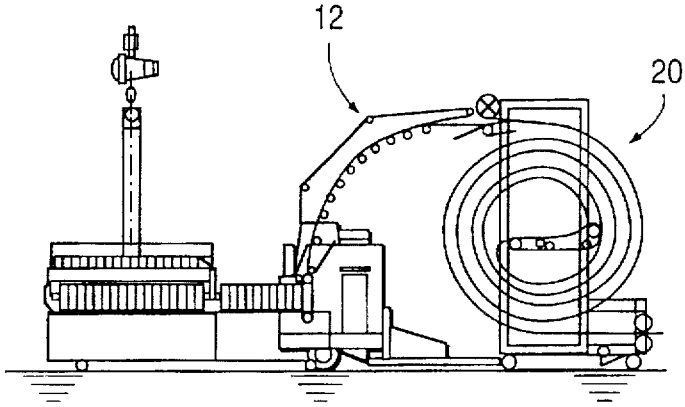
Figure 6B:
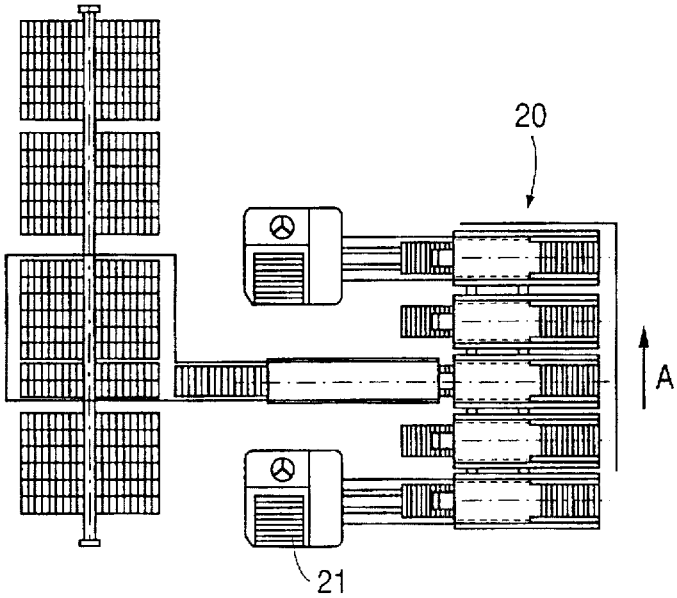

FIG. 6*a* shows a vertical cross-sectional view of a loading station for preparing discrete scaled formations from manipulateable stacks, FIG. 6*b* shows an overhead view of the loading station of FIG. 6*a;*

Figure 7:
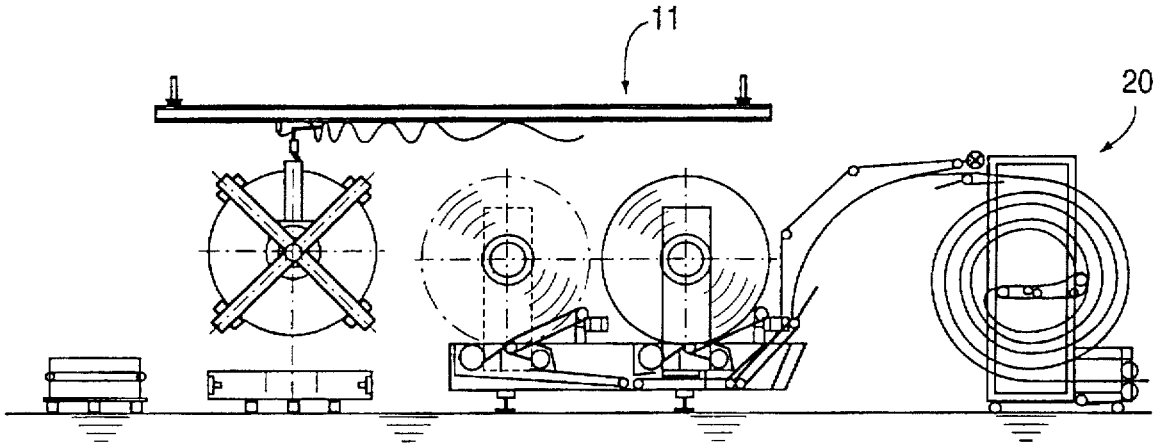
Figure 8:
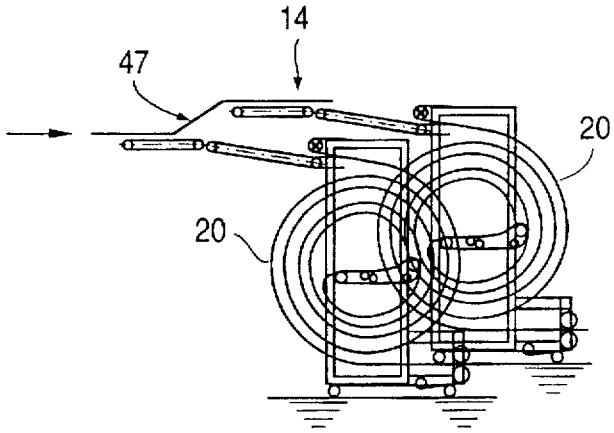

FIG. 7 shows a loading device in the form of a winding station for preparing discrete scaled formations from rolls; and FIG. 8 shows a loading station where supplying devices are loaded with discrete scaled formations produced from continuously provided products.

DETAILED DESCRIPTION OF THE INVENTION

Figure 1:
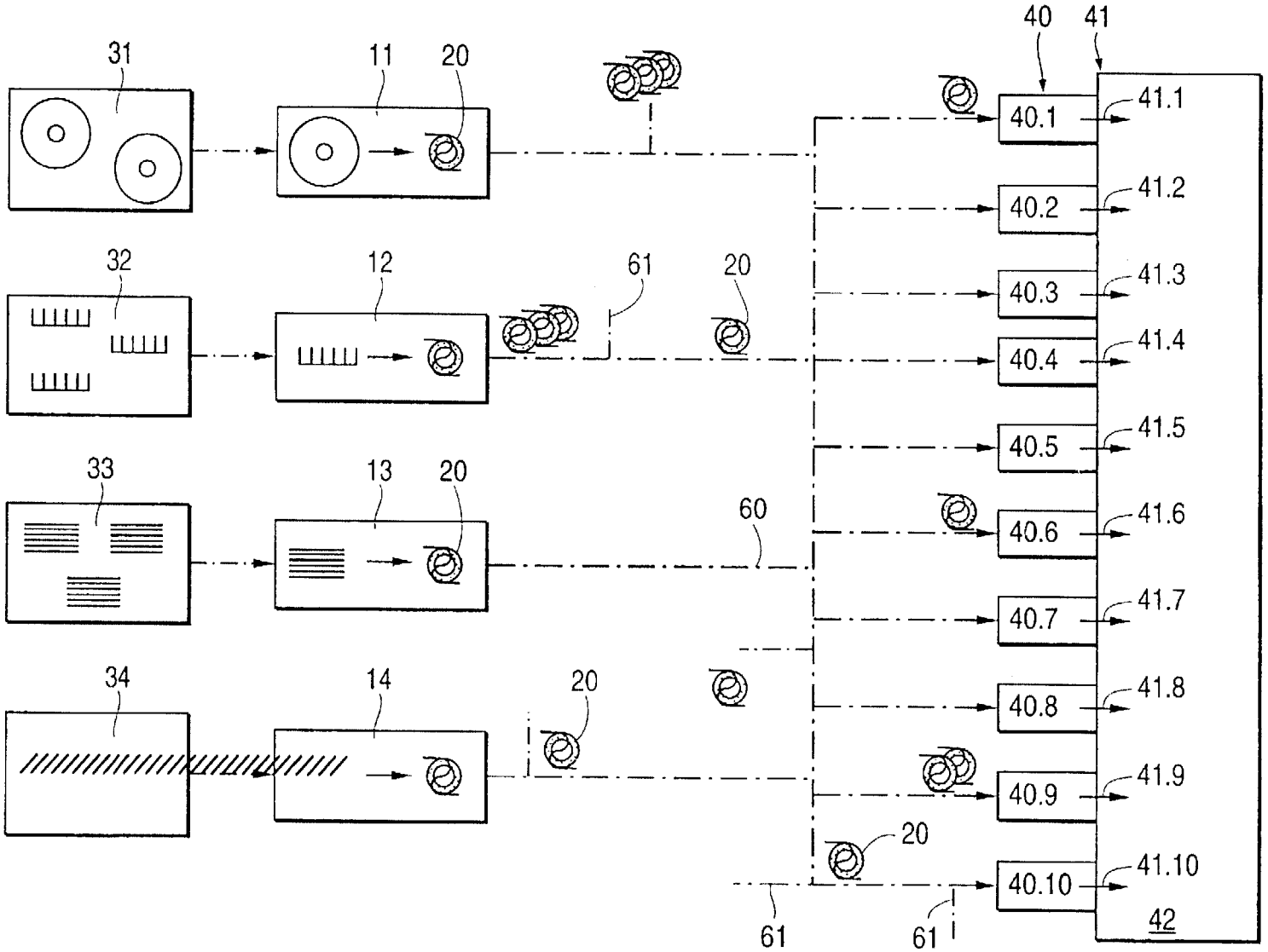

FIG. 1 diagrammatically shows an inventive system with the help of which the inventive method is to be explained.

The shown system comprises four loading devices 11, 12, 13 and 14. With each of these loading devices, one kind or a group of similar kinds of product formations are made into discrete scaled formations, and these discrete scaled formations are loaded onto mobile supplying devices 20. Loading device 11 serves for the transformation of wound formations (rolls), loading device 12 for the transformation of manipulateable stacks, loading device 13 for the transformation of vertical stacks and loading device 14 for the transformation of a continuous scaled stream. Loading devices such as loading devices 11 to 13 are advantageously arranged in the area of storage locations 31 to 33 in which storage locations corresponding storage formations are stored. Loading device 14 for the transformation of a continuous scaled stream into discrete scaled formations is arranged in the area of a device 34 releasing a scaled stream or in the area of a different processing device respectively.

The system according to the invention further comprises a plurality of feeding points 41 (41.1 to 41.10) to one or to various processing stations (marked 42) to each of which feeding points a feeding buffer 40 (40.1 to 40.10) is allocated.

A mobile supplying device 20 loaded by one of the loading devices transports a discrete scaled formation from the loading device to a feeding buffer 40 e.g. along one of the broken lines, whereby loaded as well as unloaded supplying devices 20 can be intermediately stored on the way, which fact is shown diagrammatically with dead ending path branchings 61. Supplying devices 20 can also be stored intermediately before or after transport, i.e. at loading devices 11 to 14 or at feeding buffers 40.

From FIG. 1 it can clearly be seen that on each side (left and right in the Figure) of the loading devices 11 to 14 there is an order: the order on the right side being controlled by the further processing (42), the one on the left side by the formation of the products to be handled. By the co-operation of loading devices 11 to 14, supplying devices 20 and feeding buffers 40 the two orders are largely uncoupled from each other. The temporal uncoupling is at its highest if unloading supplying devices 20 at feeding buffers 40 is very fast compared with the actual feeding. The local uncoupling is at its highest if the supplying devices 20 used in the system are randomly interchangeable and if the feeding buffers 40 are functionally identical. By uncoupling the two orders, the operation rate or the necessary number of identical loading stations becomes dependant on the overall amount of products provided in the specific storage formation to be supplied and not being dependant any more on the amount of feeding points to be supplied with these products as was the case with methods according to the state of the art. This advantage leads not only to a saving of labor with regard to operation personnel, but also to the fact that each loading device or operator respectively can work at their own optimal rhythm. Additionally, the uncoupling makes it possible to very carefully remove inferior products in the area of the loading devices even with high fluctuations of quality in the products to be supplied without effect on the further processing. This not only has a positive effect on the economy of the further processing but also on the quality of the end product.

For an optimal totally flexible operation of a system as shown in FIG. 1, an unlimited number of supplying devices 20 is required. For restricting this number, it may be advantageous to design at least one loading device 11 to 13, e.g. a winding station, such that it can also be used as an unloading station or to provide a separate unloading station. In this unloading station, supplying devices loaded in loading station 14 are unloaded, and storage formations are formed and stored.

The system according to FIG. 1 can be extended simply at any time by providing at least one corresponding loading device for each further kind of product formation to be handled, by providing a plurality of similar loading devices working parallel to each other and/or by increasing the number of feeding points with feeding buffers.

Figure 2:
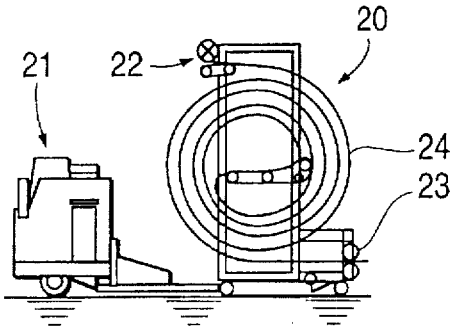
FIG. 2 shows a preferable embodiment of the supplying device which can be loaded with a discrete scaled formation, transported and if required stored intermediately.

FIG. 2 shows a preferred embodiment of a supplying device 20 which is mobile with the help of a transport vehicle 21. The principle of this supplying device is described in the Swiss patent application No. 000009/95 (F401). It is basicly an arrangement of a pair 24 of conveying means in the form of a double spiral whereby one of the conveying means is e.g. a passive means (e.g. a roller conveyer with freely rotating rolls) and the other an active means (e.g. a drivable conveying belt). The two conveying means run substantially parallel and form a conveying line which commences on the circumference of the spiral (entry 22), leads to the center in an entrance spiral and between the windings of the entrance spiral in an exit spiral back to the circumference (exit 23). Printed products stored in the supplying device are clamped between the two conveying means along the whole double spiral conveying line or along a part of it as a scaled formation with a scale distance which is as small as possible. At least one of the conveying means (active means) is driven by an internal or external drive. This causes products at entry 22 to be moved along the conveying line and/or causes products present in the device in the area of exit 23 to be released from the device along the conveying line. By reversing the direction of drive, entry and exit of the device can be interchanged selectably. During transport and intermediate storage, the active conveying means is not driven.

It is of course, not a condition to the inventive method that the supplying device 20 comprises a conveying line in the form of a double spiral. Every other conveying line with entry and exit is also possible, whereby entry and exit may coincide. The advantage of a spirally course is the fact that it makes a compact and particularly narrow design of the supplying device possible (substantially no wider than the scaled formation) such that the device requires little space in the locations of intermediate storage and especially when unloading. The advantage of a device with separate and selectably interchangeable entry and exit is that it can be run "first in-first out" as well as "first in-last out".

The supplying device 20 shown in FIG. 2 can be designed such that it has a capacity of e.g. 220,000 pages on a conveying line of e.g. 30 m and can be loaded or unloaded respectively in e.g. 30 sec.

The transport vehicle 21 shown in FIG. 2 is a commercially available fork lift truck driven by a driver. Instead of such a transport vehicle a robot-vehicle controlled by a superimposed intelligence can be used.

Figure 3:
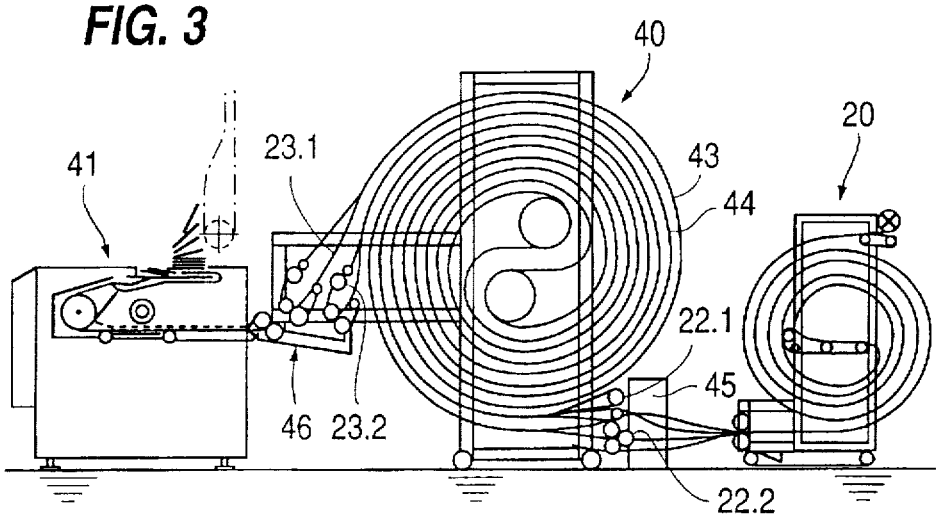
FIG. 3 shows a preferable embodiment of a feeding buffer one of which is, according to the inventive method, allocated to each feeding point of an inventive system.

FIG. 3 diagrammatically shows a preferred embodiment of a feeding buffer 40. This feeding buffer, which is also described in the above named patent application, substantially consists of two conveying lines 43 and 44, each in the form of a double spiral of the same kind as shown in the supplying device according to FIG. 2. The two double spirals each comprise an entry 22.1 and 22.2 an exit 23.1 and 23.2 and an independent drive (not shown) and are preferably interwound as shown, in order to be space saving, especially in what concerns their width. The two entries 22.1 and 22.2 are connected with an automatically operated switch point 45 and can therefore selectably be brought into line with the exit of a supplying device 20. The two exits 23.1 and 23.2 are connected rigidly to the actual feeding point 41 via a further automatically operated switch point 46. In the same time as printed products are fed from one of the double spirals into processing, the other double spiral is loaded from a supplying device. A feeding buffer 40 advantageously has twice the capacity of a supplying device 20 and is designed such that it can be loaded at the same speed as the supplying device can be loaded or unloaded respectively.

For supplying a feeding point, e.g. into a collecting machine in which 20,000 items per hour are produced from individually supplied folded sheets (4 pages), one loaded supplying device must be unloaded at each feeding buffer every average 2.75 hours. Compared to a loading time of e.g. 30 sec this is a very long time, i.e. a high temporal uncoupling between the processing or the feeding respectively and the preparatory steps.

Figure 4:
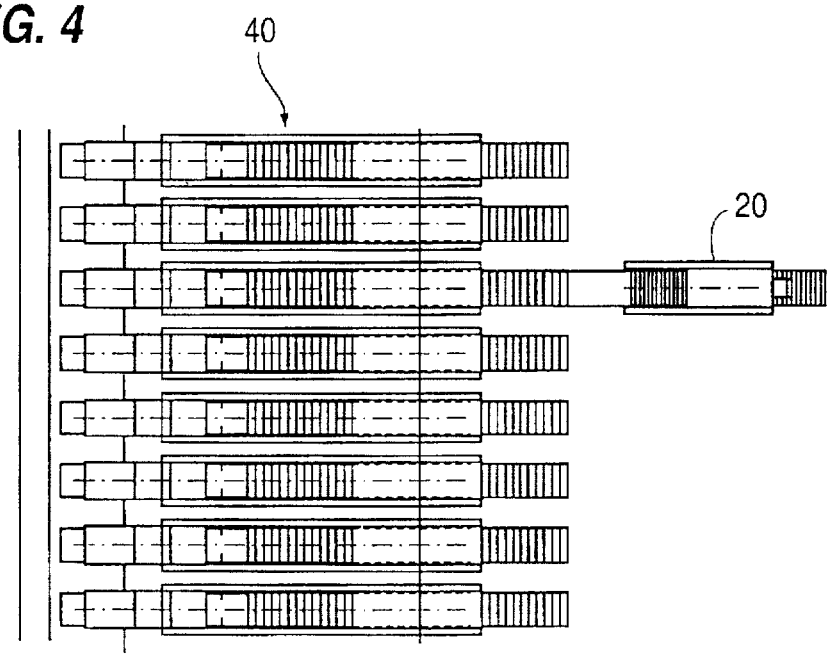
FIG. 4 shows a horizontal projection of a plurality of feeding points with feeding buffers and with a feeding device feeding a buffer.

FIG. 4 shows a view from above on eight feeding points with eight feeding buffers in order to show more clearly the space conditions in the area of such feeding points e.g. of a collecting or inserting drum. A supplying device 20 is coupled to one of the feeding buffers. The shown feeding buffers 40 and the supplying device 20 correspond to the embodiments shown in FIGS. 2 and 3.

Figure 5:
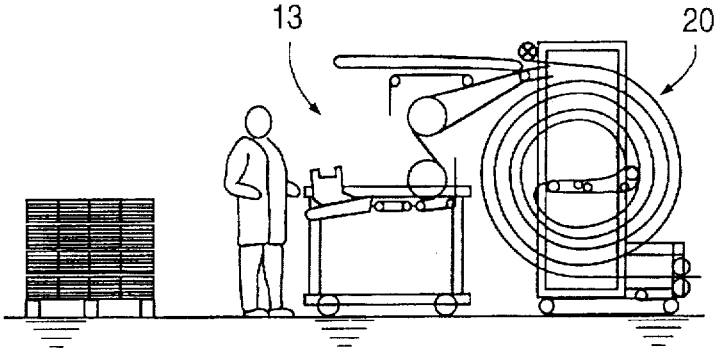
FIG. 5 shows a manned loading device for preparing discrete scaled formations from layers or packages.

FIG. 5 shows a manned loading device 13 in which discrete scaled formations are made from vertical stacks and are loaded onto supplying devices 20. Loading device 13 substantially corresponds to a known sheet feeder.

FIG. 6*a* shows a vertical cross-sectional view of substantially automatically operated loading device 12 FIG. 6*b* shows the loading device of FIG. 6*a* viewed from above. Discrete scaled formations are produced from manipulateable stacks and are loaded onto supplying devices 20. FIG. 6*b* shows that means for shifting supplying devices 20 laterally (arrow A) between loading steps are provided, and that such an intermediate storage for empty and loaded supplying devices is formed.

With loading devices as shown in FIGS. 5, 6*a* and 6*b*, supplying devices, as described in connection with FIG. 2 can easily be loaded in five minutes. In other words, this means that for the example mentioned above regarding feeding into a collecting machine, up to thirty feeding points can be supplied with one such loading device.

FIG. 7 shows a known unwinding station 11 used as loading device. With this unwinding station, products are unwound from rolls and usually loaded into a supplying device after a reduction of the scale distance. If required, the scaled stream is rewound or reversed between roll and supplying means 20 for establishing the desired scale orientation.

FIG. 8 shows a loading device 14 by which one of two parallel supplying devices 20 is selectably loaded from a substantially continuous scaled stream. It is again advantageous to reduce the distance between scales with suitable means before or after the switching point.

All devices shown in FIGS. 2 to 8 are substantially known to one skilled in the art such that it is unnecessary to describe the details of these devices in this place.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. Method for supplying printed products or intermediate products for printed products to defined feeding points of stations for further processing the products, whereby the products are selectably provided in the form of discrete storage formations consisting of a plurality of products or in substantially continuous form and whereby the products are supplied to the stations for further processing in the form of a plurality of substantially continuous scaled streams each with a predetermined scale orientation and with a feeding speed, characterized in that in a first method step discrete scaled formations of restricted length and a predetermined scale orientation are prepared selectably from storage formations of products or from continuously provided products, that in a second method step discrete scaled formations prepared in the first step are transported to predetermined feeding points, that in a third method step each transported discrete scale formation is loaded alternatively into one part of a two-part feeding buffer allocated to one feeding point each whereby the predetermined scale orientation is maintained and the loading speed is faster than the feeding speed and in that in a fourth method step the products are fed alternatively from one or the other part of the two-part feeding buffer into the stations for further processing as substantially continuous scaled formation, whereby the predetermined scale orientation is maintained.

2. Method according to claim 1, characterized in that in the first method step scaled formations are produced by unwinding printed products stored in wound formation or from vertical, manipulatable or spiral stacks which each comprise a plurality of products.

3. Method according to claim 1, characterized in that the discrete scaled formations are intermediately stored before, during or after the transporting step.

4. Method according to claim 3, characterized in that the discrete scaled formations for transporting and for intermediate storage are loaded onto mobile conveying lines.

5. Method according to claim 1, characterized in that for the transporting step discrete scaled formations are loaded onto a plurality of randomly interchangeably supplying devices.

6. System for carrying out the method according to claim 1, which system comprises a plurality of feeding points to stations for further processing, characterized in that it additionally comprises a plurality of mobile supplying devices for transporting discrete scaled formations to feeding points, a plurality of different loading devices for producing discrete scaled formations from products provided in different storage formations or from continuously provided products and for loading supplying devices with these discrete scaled formations, and a plurality of feeding buffers each strictly allocated to one feeding point, whereby the feeding buffers comprise two independently driveable buffer parts connected to a buffer entry and a buffer exit by common switch points are designed such that the scale orientation between the buffer entry and the buffer exit is not changed.

7. System according to claim 6, characterized in that the loading devices are designed as winding stations or as sheet feeders.

8. System according to claim 6, characterized in that the supplying devices comprise a pair of two conveying means substantially arranged in parallel and a drive for driving at least one of the conveying means or are connectable to such a drive, whereby the pair of conveying means forms a conveying line with an entry and an exit and whereby between the two conveying means printed products are clampable.

9. System according to claim 8, characterized in that the pair of conveying means forms a double spiral, whereby the entry and the exit lie on the circumference of the spiral.

10. System for supplying printed products or intermediate products for printed products to defined feeding points of stations for further processing the products, whereby the products are selectably provided in form of discrete storage formations consisting of a plurality of products or in substantially continuous form and whereby the products are supplied to the stations for further processing in form of a plurality of substantially continuous scaled streams each with a predetermined scale orientation, characterized in that, in a first method step discrete scaled formations of restricted length and a predetermined scale orientation are prepared selectably from storage formations of products or from continuously provided products, that in a second method step discrete scaled formations prepared in the first step are transported to predetermined feeding points, that in a third method step transported scaled formations are loaded into feeding buffers allocated to one feeding point each whereby the predetermined scale orientation is maintained and that in a fourth method step the products are fed into the stations for further processing as substantially continuous scaled formation, whereby the predetermined scale orientation is maintained;

further comprising a plurality of feeding points to stations for further processing, wherein the system additionally comprises a plurality of mobile supplying devices for transporting discrete scaled formations to feeding points, a plurality of different loading devices for producing discrete scaled formations from products provided in different storage formations or from continuously provided products and for loading supplying devices with these discrete scaled formations, and a plurality of feeding buffers each strictly allocated to one feeding point, whereby the feeding buffers are designed such that the scale orientation between the buffer entry and the buffer exit is not changed;

wherein the supplying devices comprise a pair of two conveying means substantially arranged in parallel and a drive for driving at least one of the conveying means or are connectable to such a drive, whereby the pair of conveying means forms a conveying line with an entry and an exit and whereby between the two conveying means printed products are clampable.

11. System according to claim 10, characterized in that the pair of conveying means forms a double spiral, whereby the entry and the exit lie on the circumference of the spiral.

12. System for supplying printed products or intermediate products for printed products to defined feeding points of stations for further processing the products, whereby the products are selectably provided in form of discrete storage formations consisting of a plurality of products or in substantially continuous form and whereby the products are supplied to the stations for further processing in form of a plurality of substantially continuous scaled streams each with a predetermined scale orientation, characterized in that, in a first method step discrete scaled formations of restricted length and a predetermined scale orientation are prepared selectably from storage formations of products or from continuously provided products, that in a second method step discrete scaled formations prepared in the first step are transported to predetermined feeding points, that in a third method step transported scaled formations are loaded into feeding buffers allocated to one feeding point each whereby the predetermined scale orientation is maintained and that in a fourth method step the products are fed into the stations for further processing as substantially continuous scaled formation, whereby the predetermined scale orientation is maintained;

further comprising a plurality of feeding points to stations for further processing, wherein the system additionally comprises a plurality of mobile supplying devices for transporting discrete scaled formations to feeding points, a plurality of different loading devices for producing discrete scaled formations from products provided in different storage formations or from continuously provided products and for loading supplying devices with these discrete scaled formations, and a plurality of feeding buffers each strictly allocated to ones feeding point, whereby the feeding buffers are designed such that the scale orientation between the buffer entry and the buffer exit is not changed;

wherein the feeding buffers comprise two pairs of two conveying means each substantially arranged in parallel and two drives for driving at least one of the conveying means of a pair each, whereby the two conveying means of each pair form a conveying line with an entry and an exit and whereby between the two conveying means of each pair printed products are clampable.

13. System according to claim 12, characterized in that the two pairs of conveying means have the form of a double spiral and that the two double spirals are arranged inside each other.

* * * * *